United States Patent [19]

Feucht

[11] 4,141,220

[45] Feb. 27, 1979

[54] MULTIPLE INPUT, SINGLE OUTPUT MECHANICAL ACTUATOR

[75] Inventor: Dennis D. Feucht, Morton, Ill.

[73] Assignee: Caterpillar Tractor Co., Peoria, Ill.

[21] Appl. No.: 857,066

[22] Filed: Dec. 5, 1977

[51] Int. Cl.[2] ..... F01B 21/04; F02B 73/00

[52] U.S. Cl. ..... 60/698; 60/716; 91/167 R; 92/151; 60/400

[58] Field of Search ..... 91/411 A, 167 R; 92/151, 76, 13.3, 13; 60/400, 403, 698, 701, 716, 720; 74/480 R, 480 B

[56] References Cited

U.S. PATENT DOCUMENTS

| | | | |
|---|---|---|---|
| 1,561,341 | 11/1925 | Martin | 91/167 X |
| 2,533,627 | 12/1950 | Roach | 92/13 X |
| 2,969,042 | 1/1961 | Litz et al. | 91/167 |
| 3,141,388 | 3/1964 | Brandstadter | 91/167 X |
| 3,659,113 | 4/1972 | Wagner | 307/9 |
| 3,805,669 | 4/1974 | Mitchell | 91/178 |

*Primary Examiner*—Edgar W. Geoghegan
*Attorney, Agent, or Firm*—Wegner, Stellman, McCord, Wiles & Wood

[57] ABSTRACT

A multiple input, single output, mechanical actuator including a housing, an actuator rod reciprocably mounted in the housing and having one end projecting therefrom, a plurality of aligned, signal responsive elements in the housing, each independently mounted for reciprocation therein towards and away from the rod, a plurality of signal input structures in the housing, one for each of the elements, for applying a force to reciprocably move the associated element toward or away from the rod, and a plurality of aligned, interengaging links reciprocably mounted within the housing, one for each of the elements, and operatively associated with the rod, each of the links being relatively movable with respect to its element and slidable with respect thereto for one direction of movement of the element and movable therewith in the other direction of movement of its element.

11 Claims, 2 Drawing Figures

ELECTRIC
AIR PRESSURE
OIL PRESSURE
44
46
142
144
140
138
136
146
134
66
86
88
128
70
92
90
68
104
112
110
76
102
60
80
130
100
114
74
72
62
106
38
82
64
108
32
84
122
34
132
120
118
50
56
59
58
52
26
54

MULTIPLE INPUT, SINGLE OUTPUT MECHANICAL ACTUATOR

BACKGROUND OF THE INVENTION

This invention relates to multiple input, single output, mechanical actuators which are particularly useful in connection with governors for engines or the like but not limited thereto.

A variety of mechanical apparatus utilize control mechanisms wherein a single output to the mechanism being controlled is provided by the control mechanism in response to any one or more of a plurality of input signals to the control mechanism. Such control mechanisms perform a so-called logical OR function and typically receive input signals of the same medium. For example, each input signal may be a pressurized air signal or a pressurized hydraulic fluid signal, but not both. The input signals may be in the form of electrical signals or in the form of movement of mechanical elements as well. Seldom, if at all, are input signals of different mediums utilized by a single, multiple input, single output actuator and, in many cases, it is required to convert an input signal from one medium to another prior to its application to the control device.

For example, an actuator may receive a pneumatic signal from a source of air under pressure and the apparatus controlled may also generate, as by means of a mechanically operated switch, an electrical signal. The electrical signal is converted to the air medium through the use of a solenoid operated valve prior to its application to the actuator.

Moreover, such actuators are typically designed for a predetermined number of inputs and where a particular apparatus to be controlled requires a greater or lesser number of inputs to the control device, a wholly different actuator must be employed, or input capacity wasted, or multiple actuators utilized, or combinations of the foregoing.

SUMMARY OF THE INVENTION

The present invention is directed to overcoming one or more of the above problems.

According to the present invention, there is provided a multiple input, single output, mechanical actuator comprising a housing. An actuator rod is reciprocally mounted in the housing and has one end projecting therefrom. A plurality of aligned signal responsive elements are located in the housing and each is independently mounted for reciprocation therein towards and away from the rod. A plurality of signal input means are disposed in the housing, one for each of the elements, for applying a force to reciprocably move the associated element towards or away from the rod. There is further provided a plurality of aligned, interengaging links, reciprocably mounted within the housing, one for each of the elements. The links are operatively associated with the rod and each link is relatively movable with respect to its element and slidable with respect thereto for one direction of movement of its element. The link is also movable with the associated element in the other direction of movement of its element.

Other objects and advantages will become apparent from the following specification taken in connection with the accompanying drawings.

DESCRIPTION OF THE PREFERRED EMBODIMENT

Figure 1:
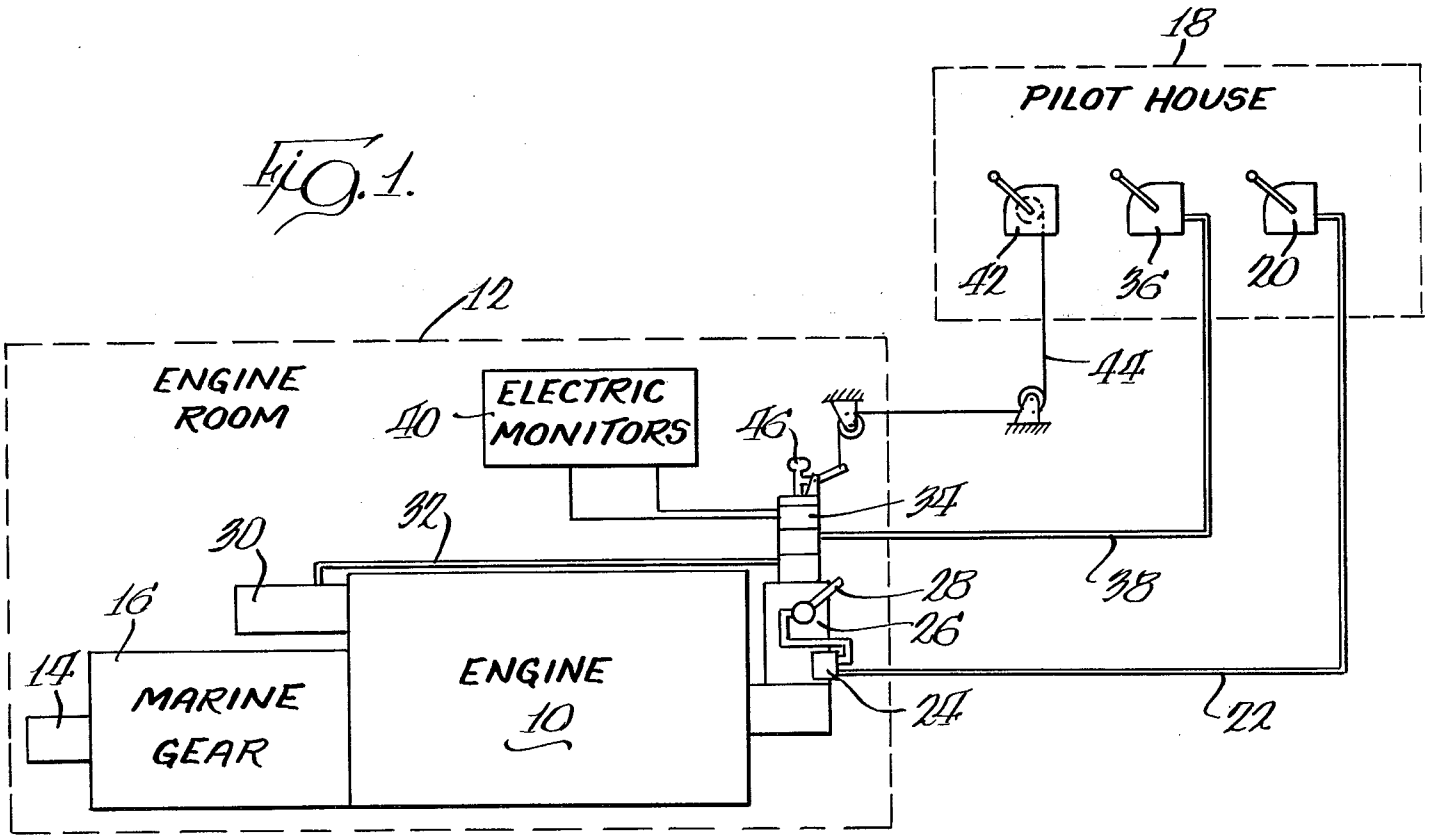
FIG. 1 is a partially schematic view of one environment of use, namely, a marine propulsion unit and control system, in which the multiple input, single output, mechanical actuator of the invention may be advantageously utilized.

With reference to FIG. 1, an actuator made according to the invention is utilized in a marine propulsion system and control therefor, but it is to be understood that the actuator of the invention is not restricted to use in such systems, but may find use in virtually any control system requiring a mechanical output which is responsive to plural inputs of the same or different mediums.

The marine drive includes an engine 10 contained in an engine room 12 in a ship or the like. The engine 10 drives a propulsion shaft 14 connected to a propeller or the like (not shown). The shaft 14 receives rotational power from the engine 10 via a gear unit 16.

The engine 10 is normally controlled from a pilot house 18 having a conventional speed control 20 connected via an air conduit 22 to a conventional air pressure controller 24 to an engine speed governor 26. The governor 26 may be, for example, a Woodward UG 8 governor manufactured by Woodward Governor Nederland B. V. of Hoofdorp, The Netherlands and forms no part of the present invention. The governor 26 may also be manually controlled within the engine room by means of a conventional mechanical actuator 28.

The engine 10 is provided with a hydro mechanical sensor apparatus 30 of the type available from Caterpillar Tractor Co., the assignee of the present application, as part No. 3N5760. The sensor apparatus 30 will typically monitor the oil pressure of the engine 10, the water temperature in its cooling system, and sense an overspeed condition of the engine 10. When any one of the foregoing parameters reaches an undesirable level, the sensor shutoff apparatus 30 will provide to a conduit 32, a high pressure, hydraulic signal.

The conduit 32 extends to a multiple input, single output, mechanical actuator 34 made according to the invention which, as will be seen, includes a mechanical output which may bear against the conventional shutdown rod of the governor 26, when actuated, to cause the latter to shut off the engine 10.

The pilot house includes a manual control 36 which, when actuated, is adapted to send a high air pressure signal via a conduit 38 to the actuator 34 to achieve the same function. In addition, electrical sensors, shown schematically at 40, may be connected to the actuator 34 and may monitor any of a variety of functions and provide an electrical signal to the actuator 34 in appropriate cases to cause shutdown.

In some cases, the manual control 36, which relies upon air pressure, may be omitted entirely and, in such a case, it is desirable to provide a further manual control 42 in the pilot house 18 which can be actuated to engage the shutdown rod of the governor 26 to disable the engine 10. Alternately, the additional manual control 42 may be utilized as a backup for the manual control 36 to be used in the event of loss of air pressure.

The manual control 42 is connected to the actuator 34 via a flexible cable 44 and is operative to cause engine shut-down in a manner to be described in greater detail hereinafter.

Within the engine room 12, there is also provided a manual actuator 46 for the actuator 34 for causing shutdown of the engine 10 via manual intervention when such shutdown is desired.

Figure 2:
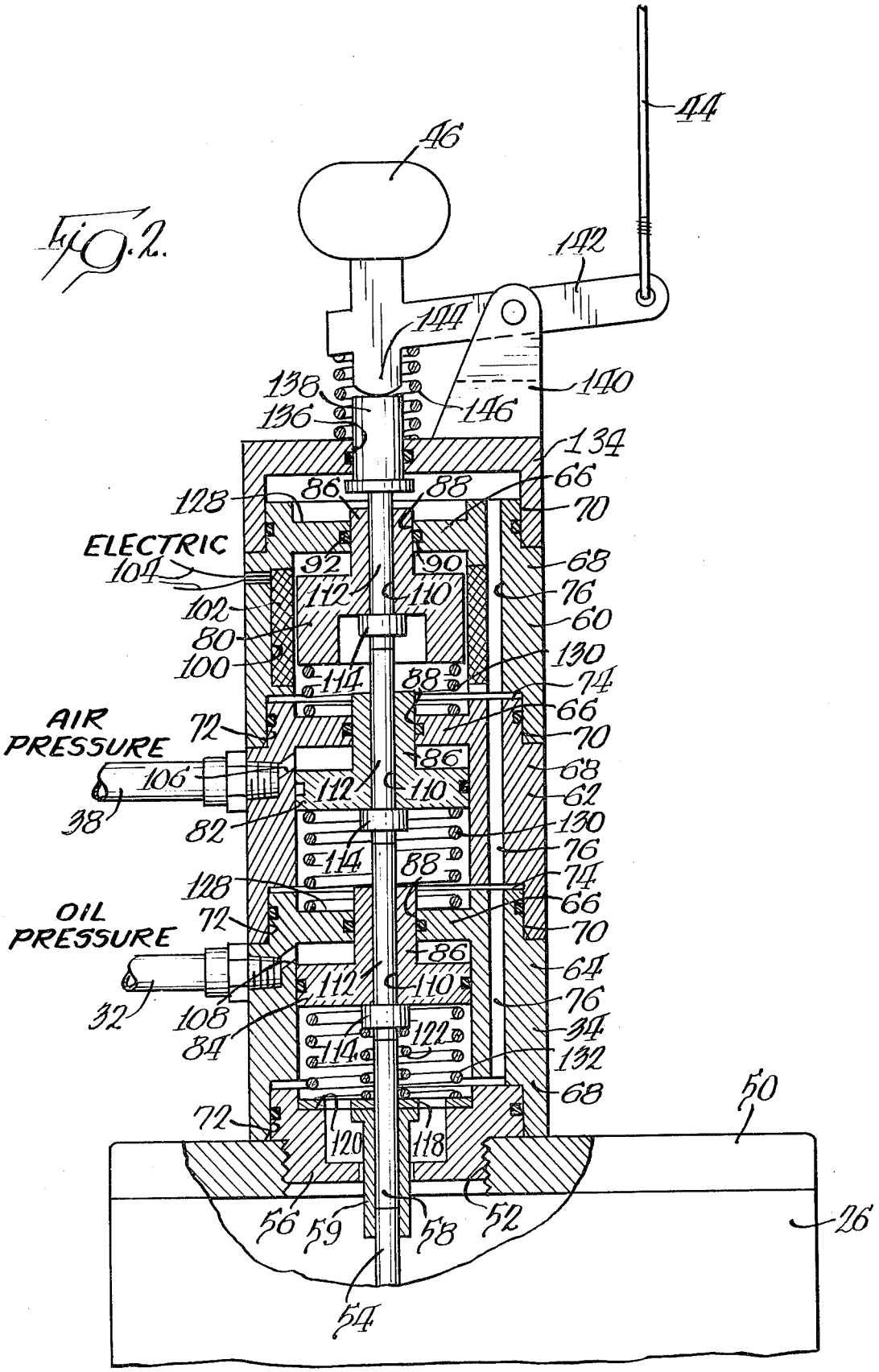
FIG. 2 is a sectional view of a multiple input, single output, mechanical actuator made according to the invention.

Turning now to FIG. 2, the actuator 34 will be described in greater detail. The governor 26 is provided with an upper cover 50 having a threaded bore 52 therein in alignment with the conventional governor shutdown rod 54. A threaded collar 56 on the base of the actuator 34 is threaded into the opening 52 such that an actuator rod 58 mounted for reciprocation within a guide sleeve 59 can engage the shutdown rod 54 and drive the same to cause the governor 26 to shut down the engine.

The actuator 34 is comprised of a housing defined by a plurality of cup-shaped housing modules 60, 62 and 64. The housing modules 60, 62 and 64 are identical except in the respects hereinafter stated and each includes a base 66 and a peripheral, generally cylindrical wall 68 extending therefrom.

Each wall 68, adjacent the base 66, is provided with an external, peripheral relief 70 which will typically be cylindrical in nature and which will have a predetermined axial length. At the same time, the end of each wall 68 remote from the base 66 is provided with an internal, peripheral relief 72, also cylindrical, and sized to nestably receive the base 66 of the adjacent housing modules 60, 62 or 64. The axial length of each internal relief 72 is greater than the axial length of each external relief 70. As a consequence, at the interface of each module there is a space 74 in fluid communication with the interior of the associated module and bounded by the radially outer extremity of the associated relief 72.

The walls 68 of each of the modules are provided with axially extending vent passages 76 which open to the base 66 of each module and to the internal relief 72 of the same module so that the interior of each module remote from the base 66 is in fluid communication with the vent passages 76 via the spaces 74. While the vent passages 76 are shown as aligned in FIG. 2, it will be appreciated that they need not be.

Each of the modules 60–64 is provided with an element 80, 82 and 84, respectively, responsive to a signal. As seen in FIG. 2, the element 80 is an electrical armature, while the elements 82 and 84 are pistons. Each element 80–84 includes an axially extending projection 86 which is slidably received in a bore 88 in the base 66 of the associated module 60–64. Each bore 88 is provided with an annular, radially inwardly opening groove 90 for receipt of an O-ring seal 92 which slidably engages the associated projection 86.

In the case of the module 60, a recess 100 is disposed in the interior surface of the wall 68 and receives an electrical coil 102 which is energizable via leads 104. When energized, it will drive the armature 80 downwardly, as seen in FIG. 2. When used in a marine application, as shown in FIG. 1, the electrical leads 104 will be connected to the electrical monitors 40.

The module 62, adjacent its base, includes an inlet port 106 whereby fluid under pressure, specifically, air from the line 38, may be directed to the upper side of the piston 82. The module 64 includes a similar inlet 108 which may be connected to the conduit 32 for receiving hydraulic fluid under pressure from the sensor apparatus 30. In the case of both of the pistons 82 and 84, in response to the application of air pressure or hydraulic pressure, respectively, the pistons 82 and 84 will be driven downwardly, as viewed in FIG. 2.

Each of the elements 80, 82 and 84 and its associated projection 86 includes an axially extending through bore 110 which slidably receives a respective one of a plurality of links 112. Each of the links 112 includes an enlarged shoulder 114 which engages the underside of its associated element 80–84 so that relative slidable movement between the link 114 and its associated element 80–84 in one direction can occur, but in the opposite direction, such movement is limited.

A perforated spanning washer 118 disposed on a shoulder 120 on the upper surface of the threaded collar 56 guides the rod 58 for reciprocal movement such that an end thereof extends out of the housing defined by the modules and a small return coil spring 122 is interposed between the washer 118 and the underside of the lowermost shoulder 114 to urge the latter into the position illustrated in FIG. 2.

It will be seen that the links 112 are coaxial with each other and in abutment with each other and further are coaxial with the actuator rod 58, with the lowermost link 112 also being in abutment therewith.

Each of the bases 66 of the modules 60–64 is provided with an axially opening recess 128 with the recess 128 in the modules 62 and 64 supporting respective, relatively large diameter coil springs 130 which engage the underside of the elements 80 and 82 of the immediately upwardly adjacent module. A similar coil spring 132 is interposed between the washer 118 and the underside of the element 84 and the springs 130 and 132 normally urge the elements 80–84 to approximately the position illustrated in FIG. 2, that is, upwardly. Various other seals are employed in the assemblage where indicated and a cup-shaped cap 134 is nested in the exterior relief 70 of the uppermost module 60. The cap 134 includes a bore 136 which slidably receives an additional link 138. The cap 134 also mounts a yoke 140 which, in turn, pivotally supports a lever 142.

The lever 142 includes a nose 144 in abutment with the upper surface of the additional link 138 and further is normally biased in a clockwise direction by a coil spring 146. The end of the lever 134 remote from the nose 144 is connected to the cable 44 such that when the cable 44 is operated by the control 42 (FIG. 1), the lever 142 will be pivoted in a counterclockwise direction to drive the additional link 138 downwardly into the housing. Preferably, the manual actuator 46 is disposed on the lever 142 in axial alignment with the nose 144 and may be in the form of a knob which can be pushed to similarly drive the additional link 138 into the housing.

Operation of the apparatus is as follows. In the event the sensor apparatus 30 senses an overspeed condition, improper oil pressure, or, undesirable water temperature, it will generate an elevated hydraulic signal which will be conveyed to the module 68 and drive the element 84 downwardly against the bias of the various springs. Because the element 84 is in abutment with the shoulder 114 on its associated link 112, the latter will be moved downwardly to also move the rod 58 downwardly against the shutdown rod 54 to cause the governor 26 to halt the engine 10. During such downward movement, the only force resisting the same will be that provided by the return spring 122 by reason of the fact that the abutment connection between the link 112 associated with the module 64 and the link 112 associated with the module 62 will extend.

In the case of an air pressure signal generated by the control 36, the element 82 associated with the module 62 will be driven downwardly and due to the presence of the shoulder 114 on the link 112 associated therewith, that link will also be driven downwardly. Because the link 112 associated with the module 62 is in abutment with the link 112 associated with the module 64, the latter will also be driven downwardly to drive the actuator rod 58 and cause shutoff.

Should there be an electrical signal from the electrical monitors 40, the resultant energization of the coil 102 will cause a similar movement, but in this case, all of the links 112 will be moved to cause shutoff.

It will be noted that in none of the cases will movement of the elements 80–84 be resisted by other than their return springs 130 and 132 since the undersides of each such elements are vented via the spaces 74 and the vent passages 76 which can be vented exteriorly of the housing, in the case illustrated, through the perforated washer 118.

In the event manual shutdown is required, the same may be accomplished either by pulling on the cable 44 or by pushing on the knob 46, in which case, the nose 144 of the lever 142 will drive the additional link 138 downwardly and that, in turn, will cause all of the links 112 to urge the rod 58 downwardly.

From the foregoing, it will be appreciated that an actuator made according to the invention can receive actuating signals from the same or a variety of different mediums. In the specific form illustrated in FIG. 2, four different mediums of signals have been utilized including mechanical force applied through the lever 142, electrical signals applied through the coil 102, pneumatic signals applied against the piston 82, and hydraulic signals applied against the piston 84.

It will also be appreciated that by reason of the modular construction of the actuator, as many of the modules 60–64 as are required for any given number of signal inputs may be stacked in nested relation, as illustrated, so that a wide variety of actuators having different capacilities can be formed of but essentially two different types of modules, one electric and one fluid actuated.

Finally, it will be appreciated that in a control system such as that described, use of the actuator allows shutdown of a governor in any of a wide variety of different types of mechanical or electrical failure and combinations thereof, thereby providing a highly adaptable and extremely reliable control system.

The embodiments of the invention in which an exclusive property or privilege is claimed are defined as follows:

1. A multiple input, single output, mechanical actuator comprising:

a housing;

an actuator rod reciprocally mounted in said housing and having one end projecting therefrom;

a plurality of aligned, signal responsive elements in said housing, each independently mounted for reciprocation therein towards and away from said rod;

a plurality of signal input means in said housing, one for each said element, for applying a force to reciprocally move the associated element towards or away from said rod; and a plurality of aligned, interengaging links reciprocally mounted within said housing, one for each of said elements, and operatively associated with said rod, each of said links being relatively movable with respect to its element and slidable with respect thereto for one direction of movement of its element and movable therewith in the other direction of movement of its element.

2. The multiple input, single output, mechanical actuator of claim 1 wherein said housing is defined by a plurality of interengaging housing modules, each containing a corresponding one of said elements, said links and said input means.

3. The multiple input, single output, mechanical actuator of claim 1 wherein at least one of said elements is an armature and the corresponding signal input means comprises a coil.

4. The multiple input, single output, mechanical actuator of claim 1 wherein at least one of said elements is a spring-biased piston, and the corresponding signal input means comprises a fluid receiving port opening to said piston.

5. A multiple input, single output, mechanical actuator comprising:

a housing;

an actuator rod reciprocally mounted in said housing and having one end projecting therefrom;

a plurality of aligned, signal responsive elements in said housing, each independently mounted for reciprocation therein towards and away from said rod;

a plurality of signal input means in said housing, one for each said element, for applying a force to reciprocally move the associated element towards or away from said rod; and a plurality of elongated links, one for each element, slidably received in a bore in the associated element, said links being coaxial and in abutment with each other and coaxial with said rod with one of said links engaging the end of said rod opposite said one end, each of said links further including means defining a shoulder engageable with the associated element for limiting sliding movement between the links and the element in one direction so that movement of an element in said one direction will drive the associated link in said one direction.

6. The multiple input, single output, mechanical actuator of claim 5 further including an additional link coaxial with said links and extending from said housing oppositely of said rod, said additional link being adapted to receive an actuating force externally of said housing.

7. A stackable, multiple input, single output, mechanical actuator comprising:

a plurality of housing modules in end to end relation to form a stack;

a plurality of signal responsive elements each slidably received in an associated one of said modules and reciprocable therein lengthwise of said stack;

spring means in each said module for biasing the associated element towards one end of said stack;

signal input means in each said module whereby a signal may be directed to the associated element to bias the same towards the other end of said stack;

a link in each said module and having an end extending thereout of and stop means abutting one side of the associated element and further extending slidably through the associated element;

said links being coaxial with and abutting each other and having telescoping connections therebetween; and an actuator extending from an end of said stack and engaged by the link in the housing module thereat.

8. The stackable, multiple input, single output, mechanical actuator of claim 7 wherein said housing modules are cup-shaped and said stack is defined by a nested interrelation of said modules.

9. The stackable, multiple input, single output, mechanical actuator of claim 7 wherein said modules are cup-shaped and in nested relation to define said stack, there being at least two said modules and wherein the corresponding elements each comprise a piston having an extension on one side slidably received in a first bore in the base of the corresponding cup-shaped housing module, with the associated link being slidably received in a second bore in the corresponding piston and extension and a seal at the interface of each said first bore and corresponding piston extension.

10. The stackable, multiple input, single output, mechanical actuator of claim 7 wherein said modules are cup-shaped and in nested relation to define said stack, there being at least two said modules and wherein the corresponding elements each include an axial extension provided with a bore and slidably received in a bore in the base of the corresponding cup-shaped housing module, each link being slidably received in the corresponding extension bore, and wherein said spring means include at least one coil spring engaging an element oppositely of said extension and abutting the base of the adjacent housing module.

11. The stackable, multiple input, single output, mechanical actuator of claim 7 wherein each said module is cup-shaped and has a base and a peripheral wall, said wall, adjacent said base, having an external peripheral relief of a first axial length, and remote from said base having an internal peripheral relief of a second axial length greater than said first axial length and nestably receiving the base of the adjacent module, and axially extending vent passages in said walls of said modules and opening to said internal peripheral reliefs and said bases, the differing axial lengths of said reliefs establishing spaces in fluid communication with the interiors of said modules and with said vent passages.

* * * * *